US005178084A

United States Patent [19]

Rohr

[11] Patent Number: 5,178,084

[45] Date of Patent: Jan. 12, 1993

[54] MULTIPLE NEEDLE CHAINSTITCH SEWING MACHINE

[75] Inventor: Günter Rohr, Hemmingen, Fed. Rep. of Germany

[73] Assignee: Union Special GmbH, Stuttgart, Fed. Rep. of Germany

[21] Appl. No.: 753,706

[22] Filed: Sep. 3, 1991

[30] Foreign Application Priority Data

Sep. 6, 1990 [DE] Fed. Rep. of Germany ..... 4028216

[51] Int. Cl.[5] ..... D05B 65/00

[52] U.S. Cl. ..... 112/286; 112/294; 112/163

[58] Field of Search ..... 112/286, 285, 289, 253, 112/294, 295, 298, 293, 163, 165

[56] References Cited

U.S. PATENT DOCUMENTS

| | | | |
|---|---|---|---|
| 3,998,162 | 12/1976 | Marforio | 112/293 |
| 4,098,209 | 7/1978 | Schopf | 112/298 |
| 4,683,828 | 8/1987 | Matsumoto | 112/294 |
| 4,850,293 | 7/1989 | Norz et al. | 112/253 X |

FOREIGN PATENT DOCUMENTS

| | | | |
|---|---|---|---|
| 0405903 | 1/1991 | European Pat. Off. | 112/285 |
| 2538916C2 | 11/1983 | Fed. Rep. of Germany . | |
| 3531595A1 | 3/1987 | Fed. Rep. of Germany . | |
| 59-55286 | 3/1984 | Japan | 112/285 |
| 61-45796 | 3/1986 | Japan | 112/285 |
| 2209542A | 5/1989 | United Kingdom . | |

*Primary Examiner*—Andrew M. Falik
*Assistant Examiner*—Paul C. Lewis

[57] ABSTRACT

In a trimming device for cutting a cover thread (30) on a multiple needle chainstitch sewing machine, a moveable thread catcher (15) picks up the cover thread (30), which runs between the cover thread guide (27) and a hook part (29) on the spreader (28), and presses the cover thread (30) towards a trapping and cutting device (49,51,48,40) of the trimming device which is disposed adjacent to the left-hand sewing needle (23).

6 Claims, 6 Drawing Sheets

MULTIPLE NEEDLE CHAINSTITCH SEWING MACHINE

BACKGROUND OF THE INVENTION

The invention relates to a trimming device for cutting a cover thread on a multiple needle chainstitch sewing machine.

It is known from British Patent Specification No. 2209542A to catch a cover thread between a spreader and the upper side of a presser foot and to guide it towards a combined catching and cutting device, which is disposed in front of the spreader. This produces a cover thread direction, which points obliquely forwards and which permits secure binding of the cover thread about the needle threads on the workpiece in the case of short starting needle threads, but, because of the structural design, impedes handling of the workpiece during the sewing operation, since the combined catching and cutting device is disposed both to the side of and below the spreader.

A further trimming device is known from published German patent application No. 35 31 595 A1. This "Offenlegungsschrift" describes a moveable cutting knife for cutting the top cover thread, which is provided with a hook edge and which is moved mechanically backwards and forwards between the spreader and the workpiece from a diagonal upper rear direction towards the middle of the cover thread. This device produces long starting needle threads, which may impede some sewing operations. Following termination of sewing, these thread ends must be additionally trimmed in order to obtain a visually acceptable sewn product.

Cutting of the remaining sewing threads at the end of the seam is generally known and is described, for example, in German Patent Specification No. 25 38 916 C2.

It is an object of the invention to provide a trimming device such that, on commencement of sewing, on the one hand only short thread ends project from the workpiece and, on the other hand, handling of the workpiece by the operator during the sewing operation is not impeded.

SUMMARY OF THE INVENTION

The present invention resides in a trimming device for controlled cutting of a cover thread on a multiple needle chainstitch sewing machine, having at least a left-hand and a right-hand sewing needle each guiding a respective needle thread; a workpiece support; a presser foot; a cover thread guide; a spreader with a hook part for picking up the cover thread; a moveable thread catcher for picking up the cover thread between the upper side of the presser foot and the cover thread guide, the thread catcher having a knife edge; a cutting knife; and a cover thread trap, in which the thread catcher is so guided and driven that it is moveable from a rear, lower resting position behind the spreader to an upper, front catching position above the spreader and thence back into the resting position, and, during its catching movement towards the resting position, the thread catcher picks up the cover thread, which runs between the hook part of the spreader and the cove thread guide, and presses it towards the thread trap, which is disposed in the region of the left-hand sewing needle, and towards the cutting knife, which is associated with the thread trap and is at a distance therefrom.

The fact that the thread catcher co-operates with drive parts and guide parts in such a way that the thread catcher is moveable from a rear, lower resting position behind the spreader to an upper, front catching position above the spreader and thence back into the resting position makes it possible to handle the workpiece in an unimpeded manner with short starting needle threads during the sewing operation. During the catching movement of the thread catcher towards the resting position above the upper side of the presser foot, the thread catcher picks up the cover thread, which runs between the hook part of the spreader and the cover thread guide, and presses it towards the thread trap, which is disposed in the region of the left-hand sewing needle, and towards the cutting knife, which is associated with the thread trap and is at a distance therefrom.

Preferably, a reciprocable connecting rod is articulated to one of two arms of the thread catcher, which is pivotally mounted. This produces a particularly simple and cost-effective construction.

With regard to simple actuation of the thread catcher, which is pivotally mounted between the cutting knife and the thread trap, a pneumatic cylinder is provided as the drive in a preferred embodiment.

In one embodiment, a spring, which is in the form of a leaf spring, acts by its free end on the cutting knife. The trimming pressure between the cutting knife and the thread catcher is adjustable by means of a screw.

In one embodiment, the thread trap comprises a leaf spring which permits adjustment of the trapping pressure between the thread trap and the thread catcher, such that, depending on the type of cover thread, the trapping pressure may be additionally optimised.

BRIEF DESCRIPTION OF THE DRAWINGS

The invention is further described, by way of example, with reference to the accompanying drawings, in which.

DETAILED DESCRIPTION OF PREFERRED EMBODIMENTS

Figure 1:
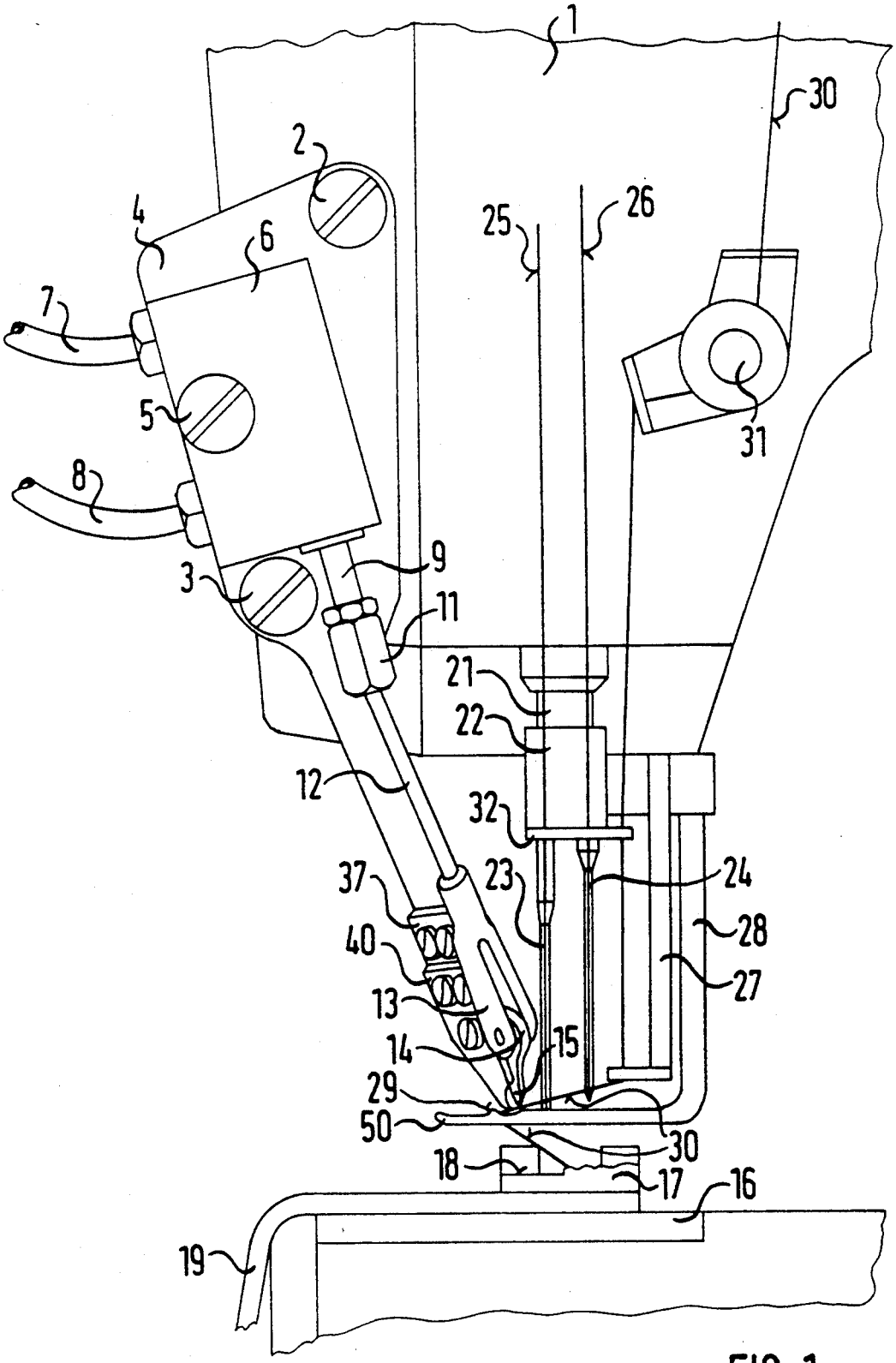
FIG. 1 is a front view of a trimming device for cutting a cover thread on a multiple needle chainstitch sewing machine.

FIG. 1 shows the arrangement of a trimming device on a multiple needle chainstitch sewing machine, which comprises a housing 1, on which a holder 4 for the trimming device is adjustably secured by screws 2 and 3. A drive part in the form of a pneumatic cylinder 6, upon which compressed air acts at alternate ends by way of two compressed air lines 7 and 8, is secured by a screw 5 to the holder 4.

A joint 11, which serves to hold a reciprocating connecting rod 12, is disposed on a piston rod 9 and is articulated by way of a clevis 13 to a limb 14 of a moveably mounted thread catcher 15.

A workpiece 19 is clamped between a workpiece support 16 and a presser foot 17 having an upper side 18. A needle bar 21, which can move up and down, carries a needle head 22 which holds at least a left-hand sewing needle 23 and a right-hand sewing needle 24, each of which guides a respective needle thread 25 and 26.

A slotted cover thread guide 27 and a driven spreader 28 with a hook part 29 for picking up a cover thread 30 are disposed to the right-hand side of the needle head 22.

The cover thread 30 is controlled by a thread brake 31 and is guided by way of an eye 32 in the needle head 22 through the slotted top cover thread guide 27 to the hook part 29 of the spreader 28 and thence to the workpiece 19.

Figure 2:
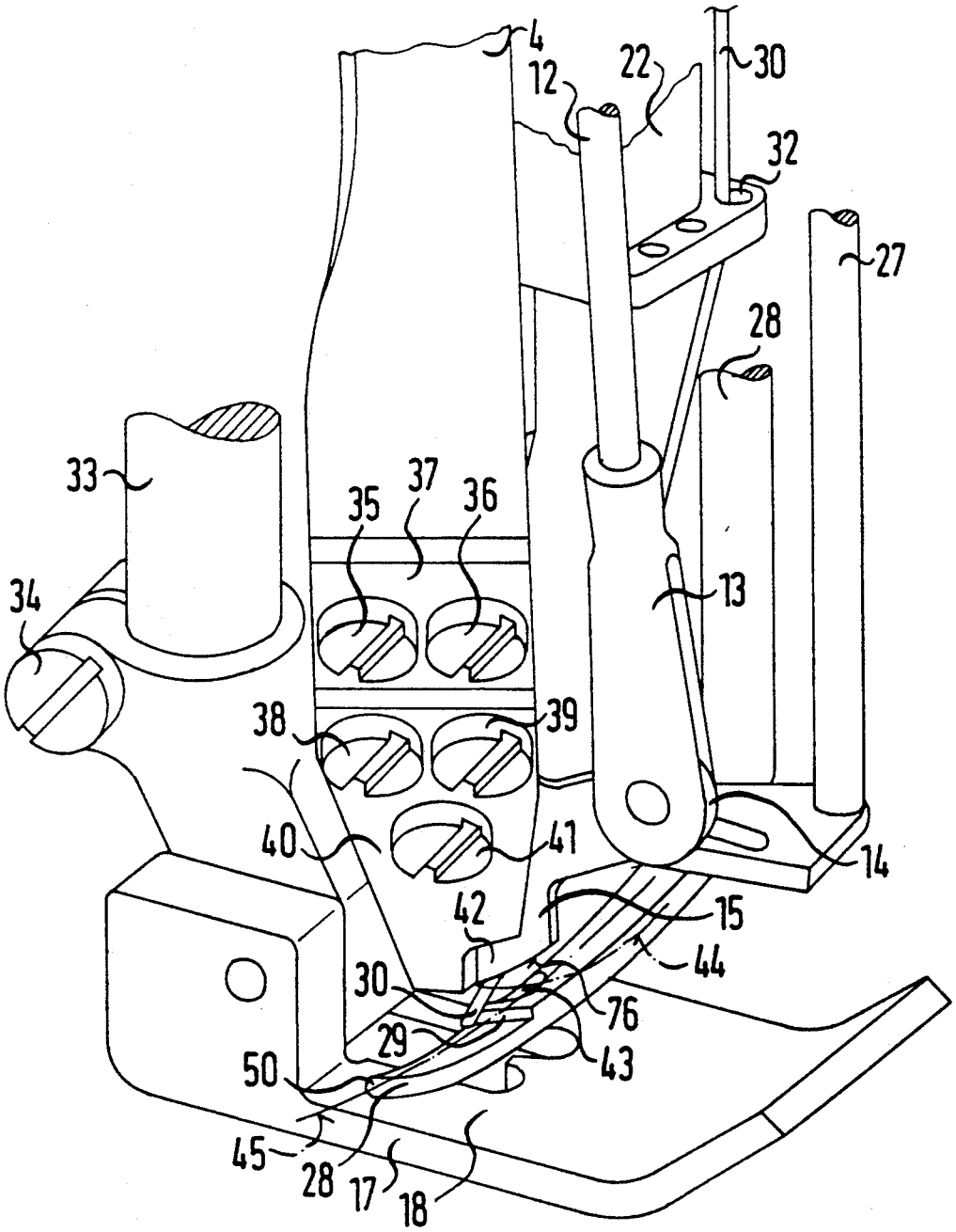
FIG. 2 is a perspective view of the trimming device from the left, with a thread catcher in a resting position.

FIG. 2 shows the presser foot 17, which is secured by a screw 34 to the presser rod 33, which is disposed in the housing 1 so as to be moveable up and down. A guide plate 37, which in turn carries a cutting knife 40, which is secured by two screws 38 and 39, is secured on the free end of the holder 4 by screws 35 and 36. The thread catcher 15 is guided by guide parts constituted by the cutting knife 40, a guide screw 41, and the guide plate 37 in an articulated manner and is pivotally mounted. It is located in a rear, lower resting position 42 (FIG. 2) above the upper side 18 of the presser foot 17 and behind the spreader 28, which has a recess 43 (FIGS. 4 and 5) to provide a path of movement 44 for the thread catcher 15. The path of movement 44 of the thread catcher 15 intersects a path of movement 45 of the spreader 28.

Figure 3:
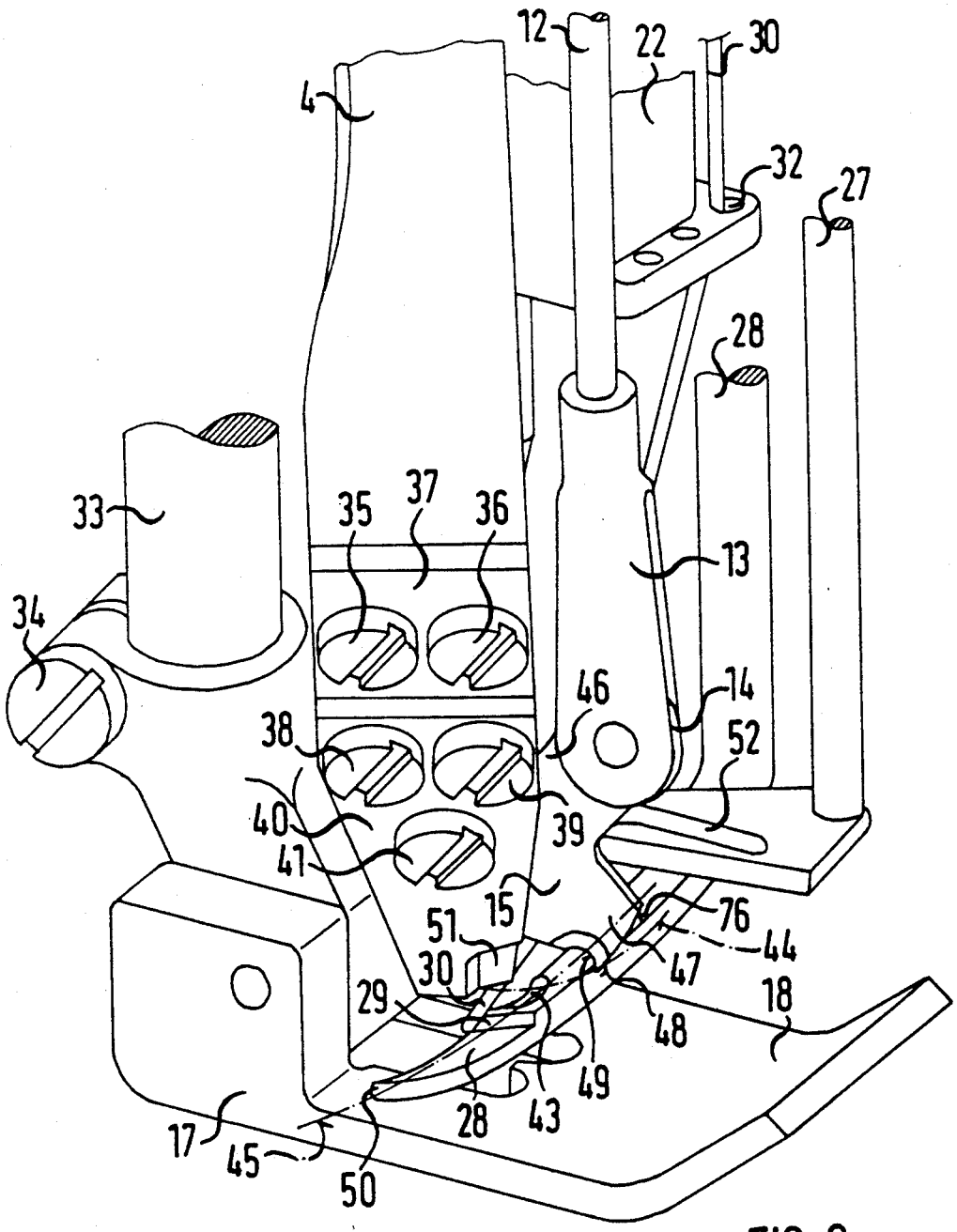
FIG. 3 is a perspective view of the trimming device from the left, with the thread catcher in a catching position.

FIG. 3 shows the trimming device for cutting the cover thread 30 with the thread catcher 15, which has two arms 46, in an upper, front catching position 47 above the spreader 28. The thread catcher 15 has a knife edge 48, which is disposed in a stepped manner with respect to an arc-shaped thread-catching edge 49. In a left-hand end position 50 of the spreader 28, the thread-catching edge 49 co-operates with a thread clamp 51 formed by the free end of the guide plate 37.

Figure 4:
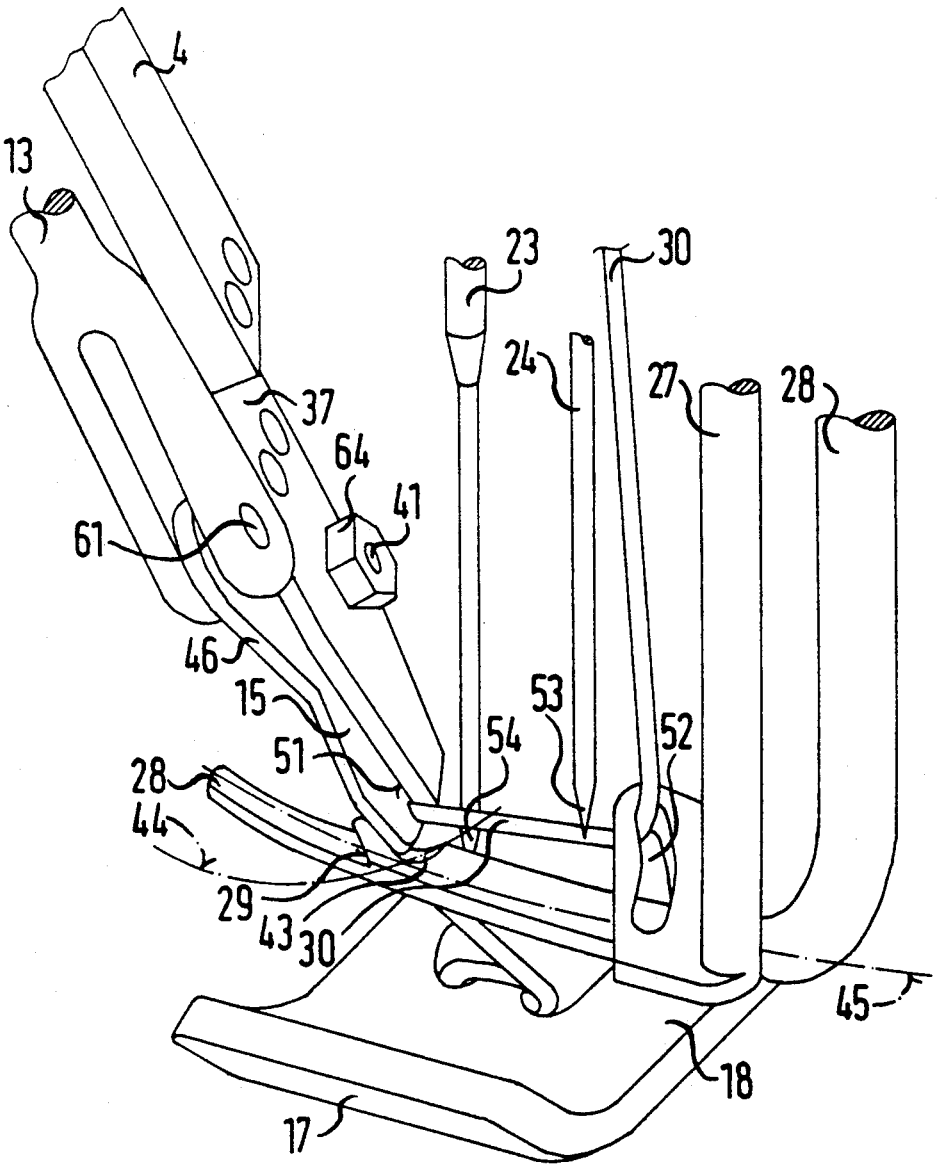
FIG. 4 is a perspective view of the trimming device from the right, with the thread catcher in the trapping-/cutting position.

FIG. 4 shows the trapping and cutting position of the thread catcher 15, which corresponds to the resting position 42. The cover thread 30 is located in a slot 52 in the cover thread guide 27 and runs behind the tip 53 of the right-hand sewing needle in front of the tip 54 of the left-hand sewing needle 23 to the thread trap 51 and to the stationary cutting knife 40, which is associated with the thread trap 51 and is at a distance 55 therefrom (FIGS. 5 and 6).

Figure 5:
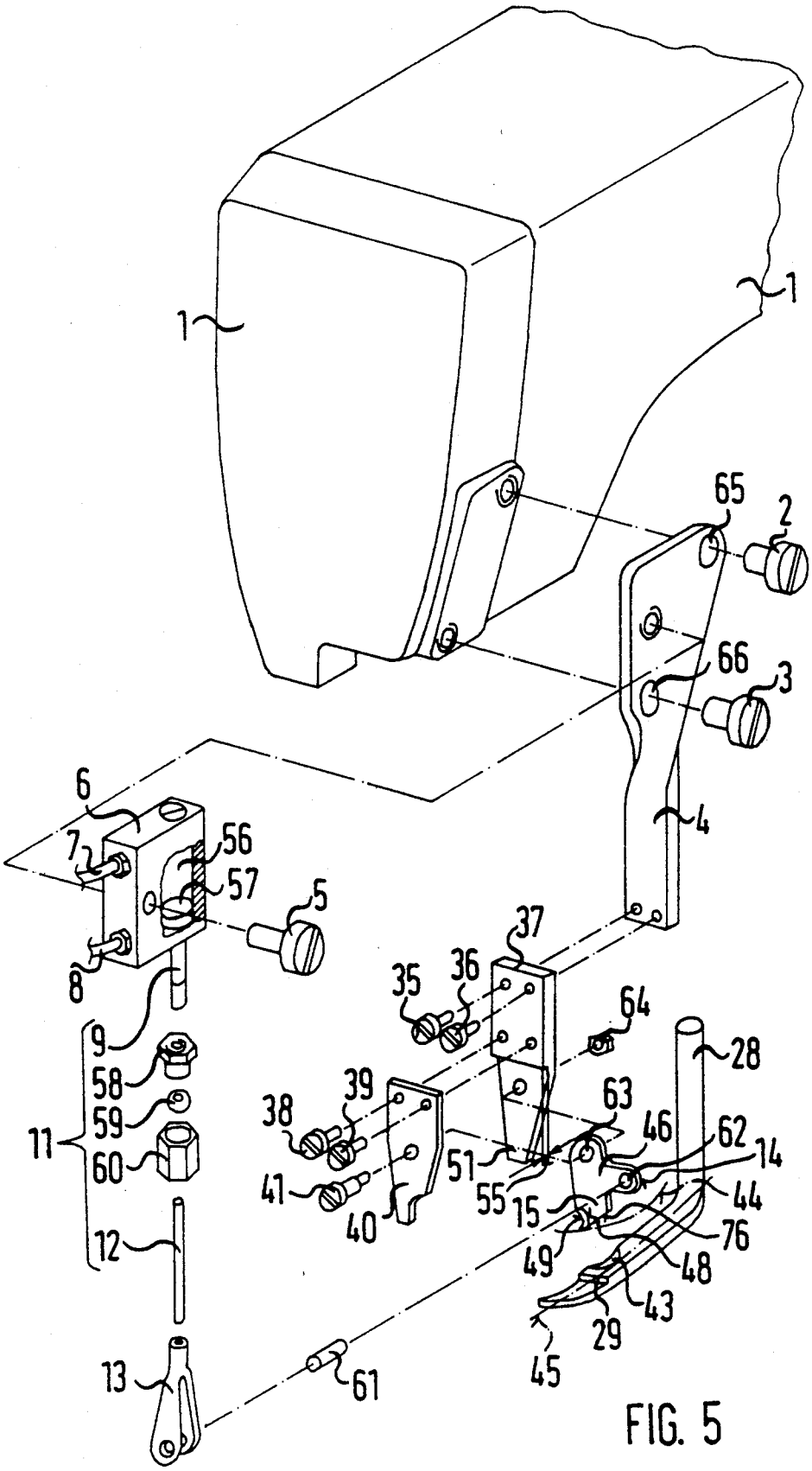
FIG. 5 is an exploded view of the trimming device.

FIG. 5 shows individual parts of the trimming device for cutting the cover thread 30. The pneumatic cylinder 6 has a chamber 56 in which a piston 57 is mounted with the piston rod 9 so as to move in a reciprocating manner. A control unit (not shown) permits the piston 57 to be changed over in a known manner, to cause opening and catching movements of the thread catcher 15. On its lower end, the piston rod 9 carries a ball holder 58, in which a hollow ball 59, which is secured to the connecting rod 12, is mounted and is secured in an articulated manner by a hollow collar nut 60, which form the joint 11. The clevis 13 has a pin 61, which projects through a bore 62 in the limb 14 of the thread catcher 15, which is in drive connection with the pneumatic cylinder 6 by way of the connecting rod 12.

The guide screw 41 which guides the thread catcher 15 is received in a bore 63 of the thread catcher 15 and is secured by a stop nut 64, which simultaneously serves to adjust the trapping and cutting pressures of the trimming device. The holder 4 is adjustably secured by way of two oblong holes 65 and 66 on the housing 1.

Figure 6:
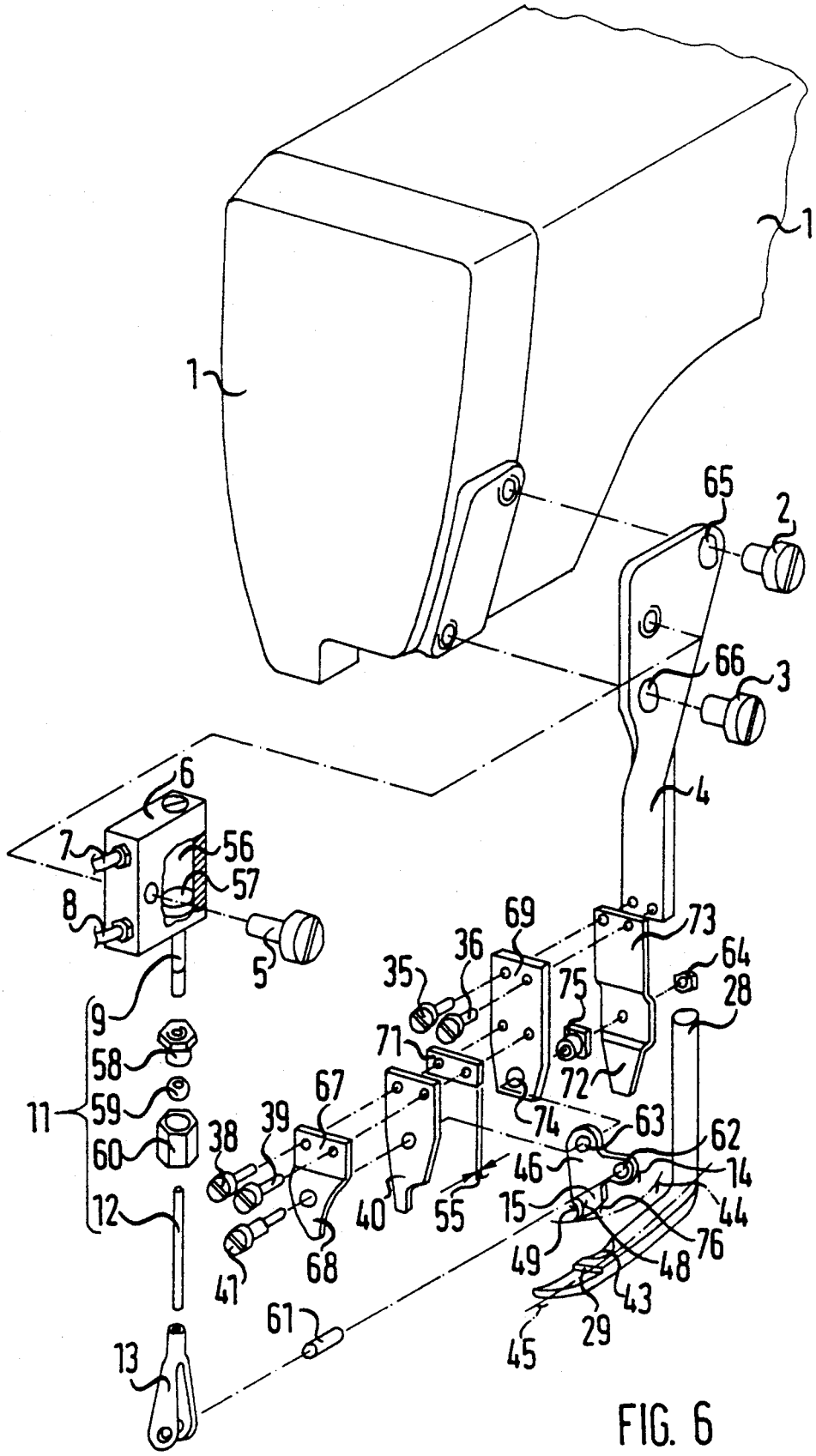
FIG. 6 is an exploded view of a further embodiment of trimming device.

FIG. 6 shows individual parts of a further embodiment of trimming device, in which the trapping and cutting pressures of the trimming device are adjustable separately. Parts which are the same or have the same function as in FIG. 5 have been given the same numerals. Adjacent to the cutting knife 40, a spring 67 which takes the form of a leaf spring 68, acts on the cutting knife 40 and is clamped by the screws 38 and 39 against the knife 40. An intermediate piece 71 is disposed at a distance 55 between a guide plate 69 and the knife 40 and is secured together with the leaf spring 68 and the knife 40 to the guide plate 69 by means of the screws 38 and 39. Beyond the guide plate 69, which is shorter than the guide plate 37 of FIG. 5, a thread trap 72 is in the form of a leaf spring 73 with an adjustable trapping pressure relative to the thread catcher 15, and is disposed between the guide plate 69 and the holder 4. A flat nut 75 is received in a bore 74 of the guide plate 69 and, because of the stepped form of the leaf spring 73, is prevented from rotating. The cutting pressure between the cutting knife 40 and the knife edge 48 of the thread catcher 15 is adjustable by turning the guide screw 41, which drivingly engages through the flat nut 75; the trapping pressure between the thread trap 72 and the catching edge 49 of the thread catcher 15 is adjustable by means of the stop nut 64.

Following termination of the sewing operation, a positioning drive (not shown) moves the needle bar 21 into the thread cutting position, for example into the raised position. A spreader drive (not shown) moves the spreader 28 into the left-hand end position 50. When the spreader is in this position, the cover thread 30 is guided in an angular manner about the hook part 29 of the spreader 28. The thread trap 51 or 72, which is disposed in the region of the left-hand sewing needle 23, on the one hand permits only a short end of the cover thread 30 to protrude from the sewn workpiece 19 following cutting of the threads, and, on the other hand, permits handling of the workpiece 19 by the operator during the sewing operation to be unimpeded.

During a cutting operation, the trimming device, which is closed during the sewing operation and is in the resting position 42, is opened by the action of compressed air flowing by way of the compressed air tube 8 into the chamber 56 to move or raise the connecting rod 12. In such case, the thread catcher 15 co-operates with the drive parts and the guide parts in such a way that the thread catcher 15 is moved from the rear, lower resting position 42 behind the spreader 28 to the upper, front catching position 47 above the spreader 28. During this opening movement, a curved edge 76 of the thread catcher 15 presses the cover thread towards the spreader 28. During the catching or closing movement of the thread catcher 15 from the catching position 47 to the resting position 42, the curved edge 49 of the thread catcher 15 picks up the cover thread 30, which runs between the hook part 29 of the spreader 28 and the cover thread guide 27, and presses or pulls it towards the thread trap 51 or 72, which is disposed in the region of the left-hand sewing needle. Since the cutting edges are offset relative to the catching edges, the cover thread is initially clamped between the thread trap 51 or 72 and the thread catcher 15, and subsequently cut by the knife edge 48 of the thread catcher against the knife 40. This produces a cover thread 30, which is clamped closely adjacent to the left-hand sewing needle 23, as can be seen in FIG. 4.

When beginning a seam on the next workpiece 19 to be sewn, the cover thread 30 is not released from the trap 51, 72 by the movement of the workpiece until a new stitch is formed, that is, it is ensured that the cover thread 30 is bound securely around the needle threads 25 and 26 when a new stitch is being formed.

I claim:

1. A trimming device for controlled cutting of a cover thread on a multiple needle chainstitch sewing machine, comprising a plurality of sewing needles, each guiding a respective needle thread; a workpiece support; a presser foot; a cover thread guide; a spreader with a hook part for picking up the cover thread; a moveable thread catcher for picking up the cover thread between the upper side of the presser foot and the cover thread guide, the thread catcher having a knife edge; a cutting knife; and a cover thread trap, said thread catcher being pivotably mounted between the cutting knife and the thread trap.

2. A trimming device as claimed in claim 1, in which one arm of the thread catcher is articulated to a reciprocable connecting rod.

3. A trimming device as claimed in claim 2, in which the reciprocable connecting rod is moveable by a pneumatic cylinder.

4. A trimming device as claimed in claim 1, in which a spring is provided adjacent to the cutting knife and acts thereon.

5. A trimming device as claimed in claim 1, in which the thread trap comprises a leaf spring having a trapping pressure which is adjustable relative to the thread catcher.

6. A trimming device for controlled cutting of a cover thread on a multiple needle chainstitch sewing machine, comprising:

a) a plurality of sewing needles each guiding a respective needle thread;

b) a workpiece support;

c) a presser foot;

d) a cover thread guide;

e) a spreader with a hook part for picking up the cover thread;

(f) means for catching the cover thread running between the hook part of the spreader and the cover thread guide;

(g) means for trapping the cover thread, said trapping means being disposed in a left-hand region of the plurality of sewing needles;

(h) means for cutting the trapped cover thread, said cutting means being disposed adjacent to one side of said trapping means;

said means for catching the cover thread being pivotably mounted between the cutting means and the trapping means for pressing said thread toward said means for trapping and said means for cutting said cover thread.

* * * * *

UNITED STATES PATENT AND TRADEMARK OFFICE

CERTIFICATE OF CORRECTION

PATENT NO. : 5,178,084

DATED : January 12, 1993

INVENTOR(S) : Günter Rohr

It is certified that error appears in the above-indentified patent and that said Letters Patent is hereby corrected as shown below:

ON THE TITLE PAGE

Under the heading "U.S. PATENT DOCUMENTS", in the first line, delete "3,998,162" and substitute --3,998,172--.

Column 1, line 62, delete "cove" and substitute --cover--.

Signed and Sealed this

Twelfth Day of July, 1994

Bruce Lehman

*Attest:*

BRUCE LEHMAN

*Attesting Officer*

*Commissioner of Patents and Trademarks*